US005096436A

United States Patent [19]

Noschese

[11] Patent Number: 5,096,436

[45] Date of Patent: Mar. 17, 1992

[54] METHOD OF MANUFACTURING A CABLE CONNECTOR ASSEMBLY

[75] Inventor: Rocco J. Noschese, Wilton, Conn.

[73] Assignee: Burndy Corporation, Norwalk, Conn.

[21] Appl. No.: 639,074

[22] Filed: Jan. 9, 1991

Related U.S. Application Data

[62] Division of Ser. No. 453,724, Dec. 20, 1989.

[51] Int. Cl.[5] ..... H01R 43/20

[52] U.S. Cl. ..... 29/876; 439/352

[58] Field of Search ..... 439/345, 347, 353–357, 439/352, 372; 29/854, 857, 874, 876

[56] References Cited

U.S. PATENT DOCUMENTS

| | | | |
|---|---|---|---|
| 4,174,875 | 11/1979 | Wilson et al. | 439/349 |
| 4,548,455 | 10/1985 | Ezure . | |
| 4,568,135 | 2/1986 | Frantz . | |
| 4,718,857 | 1/1988 | Noschese | 439/292 |
| 4,810,210 | 3/1989 | Komatsu | 439/610 |
| 4,838,808 | 6/1989 | Fujiura | 439/357 |
| 4,889,497 | 12/1989 | Riches | 439/76 |
| 4,900,262 | 2/1990 | Matsuzaki | 439/354 |
| 4,906,208 | 3/1990 | Nakamura et al. | 439/607 |
| 4,961,710 | 10/1990 | Komatsu | 439/267 |
| 4,961,711 | 10/1990 | Fujiura et al. | 439/357 |

*Primary Examiner*—Neil Abrams
*Assistant Examiner*—Khiem Nguyen
*Attorney, Agent, or Firm*—Perman & Green

[57] ABSTRACT

An electrical connector for providing a snap-lock connection and automatic disconnection from a second connector. The electrical connector has a housing, a plurality of contacts, a snap-lock latch and a movable outer hood. The snap-lock latch can automatically mechanically connect and retain the housing to a second connector. The movable outer hood can be pulled by a user after connection which disconnects the latch and results in the disconnection of the electrical connector from the second connector.

5 Claims, 5 Drawing Sheets

METHOD OF MANUFACTURING A CABLE CONNECTOR ASSEMBLY

This is a divisional of copending application Ser. No. 07/453,724 filed on 12-20-89.

BACKGROUND OF THE INVENTION

1. Field of the Invention

The present invention relates to electrical connectors and, more particularly, to an electrical connector having means for providing a snap-lock connection to and quick release disconnection from a second connector and a method of disconnecting electrical connectors.

2. Prior Art

Various different electrical connectors exist in the prior art. One particular use of electrical connectors is in cable assemblies having connectors at opposite ends of a plurality of electrically discrete wires for transmitting signals between components, such as is common in the personal computer industry wherein cables connect components such as computers with monitors, printers, joy sticks, mouses, etc. The connectors in these cable assemblies are generally provided as disconnectable plug connectors which can be plugged into or connected to a second receptacle connector in a component. However, suitable means are usually provided for at least temporarily fixedly connecting a first plug connector in the cable assembly to a second receptacle connector in the component to prevent inadvertent disconnection. Some of these means for temporary fixation include screws on the side of the cable connector that screw into the second connector, wire loops on the sides of component connector that can be deformed and received in notches on the sides of the cable connector, and beam type members on the sides of the cable connector that, by depressing buttons on the sides of the cable connector, can be pivoted to open for connection or disconnection to the component connector.

However, problems exist with prior art connectors and cable assemblies. One problem is that a person attempting to temporarily fixedly connect a cable assembly connector to a component connector usually has difficulties because of the relatively small size of pieces that must be moved such as the screws, etc.

Another problem is that the types of means that allow for temporary fixed connection between a cable assembly connector and a component connector are relatively burdensome to connect and disconnect and can sometimes take a long time, especially for a person who is not mechanically orientated.

Another problem is that the types of means that allow for temporary fixed connection between a cable assembly and a component do not provide for a quick release of the connection in circumstances such as if a person were to trip on a cable. This can sometimes result in a component, that the cable is attached to, coming crashing down from a table top and damaging the component.

It is therefore an objective of the present invention to provide a new and improved electrical connector and cable assembly that can overcome the above problems in the prior art as well as provide additional features and advantages.

SUMMARY OF THE INVENTION

The foregoing problems are overcome and other advantages are provided by an electrical connector capable of snap-lock connection to and quick release disconnection from a second connector.

In accordance with one embodiment of the present invention, an electrical connector is provided having at least one electrical contact, an inner housing comprising dielectric material, and a latch for mechanically connecting the electrical connector to a second connector. The latch comprises a first side portion, a second side portion, and a first connecting portion between the first and second side portions. The first side portion has a first leg with a first latch prong thereon. The first latch prong has a general wedge shape with a first sloped section and a second relatively non-sloped section. The second side portion has a second leg with a second latch prong thereon. The second prong has a first general wedge shape with a first sloped section and a second relatively non-sloped section. The first and second side portions are located on opposite sides of the connecting portion with the side portions and the connecting portions forming a general box shaped aperture such that the side portions and connecting portion can be slidingly mounted over a general box shape portion of said electrical connector housing and be connected thereto.

In accordance with another embodiment of the present invention, an electrical connector is provided for use in connecting a plurality of electrical wires to a second connector. The electrical connector comprises means for electrically connecting first ends of a plurality of electrical wires to contact areas in a second connector, means for housing the means for connecting including an inner housing comprising an electrically insulating material, means for mechanically connecting and retaining the inner housing with a portion of a second connector including a snap lock latch, and an outer sleeve. The outer sleeve substantially surrounds the inner housing and is generally fixedly but movably connected to the inner housing and is movable in a direction parallel to a center axis of the housing. The outer sleeve has a first home position and a second disconnect position along the center axis. The means for electrically connecting and the means for mechanically connecting both allow connection to a second connector along the center axis. The outer sleeve also comprises a latch release such that the latch can, at least partially, mechanically retain the inner housing in connection with a portion of a second connector and, upon movement of the outer sleeve from the home position to the disconnect position along the center axis, the latch release can disconnect the latch from retention with a portion of a second connector and allow the connector to be relatively easily removed in a direction along the center axis from a second connector.

In accordance with another embodiment of the present invention, an electrical connector is provided for use in connecting a plurality of electrical wires to a second connector having a latch grip. The electrical connector comprises a plurality of contact elements, a housing, a latch, and a movable outer hood. The housing substantially encases and surrounds the contact elements and has a general rectangular block shape. The latch is connected to the housing and is provided for mechanically connecting and retaining the housing to a latch grip in a second connector. The latch has two cantilevered legs projecting in a forward direction from opposite sides of the housing and has latch prongs thereon. The movable outer hood is fixedly connected to the housing and substantially surrounds the housing with a generally open rectangular channel shape having a latch disconnect therein. The hood is movable on the housing in a direction along the center axis between a forward home position and a rearward disconnect position wherein the latch can automatically mechanically connect and retain the housing, at least partially, to a second connector when the hood is in a home position and the latch disconnect can disconnect the latch from a second connector when the hood is moved from the home position to the disconnect position.

In accordance with one method of the invention, a method of manufacturing a cable connector assembly for use in connecting a plurality of electrical wires in the cable to a second connector is provided. The method generally comprises the steps of connecting first ends of the wires to a multiple contact element; covering, at least partially, the wire first ends and contact element with an electrically insulative material and, at least partially, forming a housing therewith; connecting a latch to the housing; and mounting a movable hood to the housing; the hood being longitudinally movable along the housing between a home position and disconnect position and having a latch disconnect such that when the hood is moved from its home position to its disconnect position the latch disconnect can disconnect the latch from a latch grip connected to a second connector.

In accordance with another method of the present invention, a method of disconnecting a first relatively rectangular block plug connector having at least one row of contacts therein from a second relatively rectangular block receptacle connector having at least one row of contacts therein is provided. The method comprises the steps of slidably moving a hood of the first connector from a home position along a housing of the first connector to a disconnect position, the hood substantially surrounding the housing and being fixedly but slidably mounted thereon in a direction along the center axis of the housing; laterally moving two side legs of the latch connected to the first connector housing and thereby displacing a latch prong on each side leg from a hole in latch grips of the second connector, the hood having a latch release that substantially moves the side legs as the hood is moved; and further pulling on the hood to remove the first connector housing from the receptacle connector.

In accordance with another embodiment of the present invention, a receptacle connector for use in connecting a plug connector to a printed circuit board is provided. The connector comprises a receptacle body, a plurality of contacts, and at least two side latch grips. The receptacle body is comprised of an electrically insulative material and has the plurality of context, at least partially, housed therein. The at least two side latch grips are provided for connecting sides of the body to a relatively rigid mounting member wherein the side latch grips are comprised of a relatively rigid and strong material, relative to the electrically insulative material of the body, to prevent inadvertent mechanical failure at the connection of the side latch grips with the rigid mounting member.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
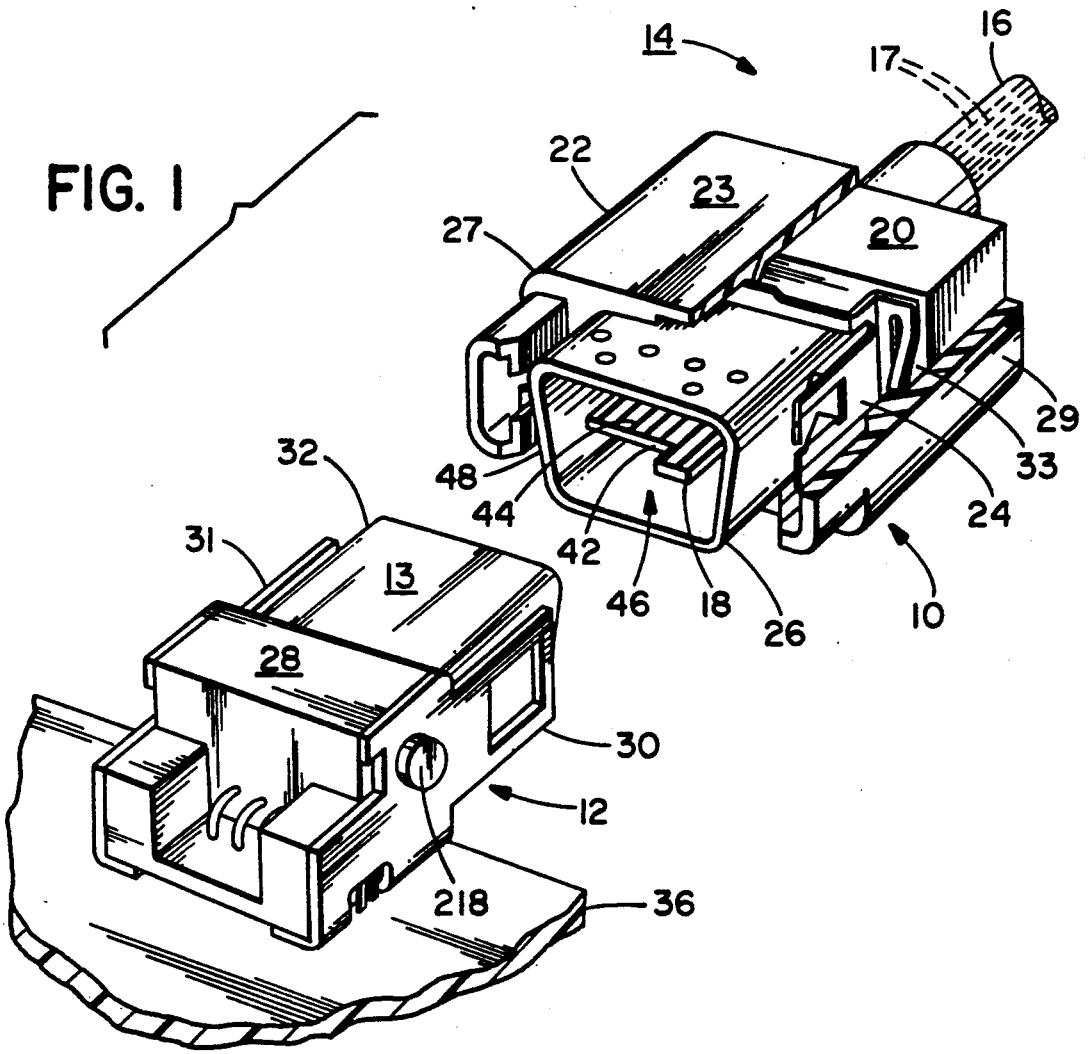
FIG. 1 is a perspective view of one end of a cable assembly intended to be connected to a receptacle connector, the cable assembly having a plug connector incorporating features of the present invention.

Referring to FIG. 1, there is shown a perspective view of one end of a cable assembly 14 having a plug connector 10 with a cut away section and a separate receptacle connector 12 connected to a printed circuit board 36 in a first electrical or electronic component. While the following description is with reference to the embodiments shown in drawings, it should be understood that the present invention is capable of use in various forms, in various types of cable assemblies and electrical components, and in varying methods of use. In addition, any suitable size, shape, or type of elements or materials can be used as will further be understood from the following description.

The cable assembly 14 is generally comprised of a cable 16, the plug connector 10 connected at a first end of the cable 16, and the second end of the cable 16 either being directly connected to a second electrical component (not shown) or having a second plug connector (not shown) for connection to the second electrical component. The cable 16 is generally comprised of a plurality of electrically insulated elongate electrical wires 17 contained in an insulative outer sheath. The wires 17 have a first end that is connected to a contact element 18 in the first connector 10 and opposite second ends (not shown) that can be connected either to a contact element in the second plug connector (not shown) or directly connected to the second electrical or electronic component (not shown). In the embodiment shown in FIG. 1, the plug connector 10 is generally comprised of a contact element 18, an inner housing 20, a movable hood or outer sleeve 22, a latch 24 and a protective grounding shell 26. In the embodiment shown, the contact element 18 is comprised of a board 42 having contact traces 44 thereon. Suitable means (not shown) are provided for connecting first ends of the wires 17 from cable 16 to the contact traces 44 as is known in the art. Means for connecting first ends of the wires 17 to the contact element 18 can include an insulation displacement connector or other suitable means. In an alternate embodiment of the present invention the contact element may include suitable pins or pin receptacles rather than the board 42 having contact traces thereon. However, any suitable type of contacts may be provided with the connector 10. The inner housing 20 generally substantially surrounds and insulates the connection of the first end of the wires 17 to the contact traces 44 on the contact element 18. In a preferred embodiment, the inner housing 20 is comprised of a dielectric premolded form having two pieces that are ultrasonically welded together to cover the connection of the first ends of the wires 17 to the contact element 18. After welding of the two pieces, the premolded form is covered by a copper tape or other conductive tape. The tape is suitably connected to a ground wire in the cable 16. After attaching the copper tape to the premolded form, dielectric material is molded over the tape to form the final block shape of the inner housing 20 as shown. However, any suitable means and elements may be used to form the inner housing 20. In the embodiment shown, the inner housing 20 is generally provided as a rectangular block shape due to the linear arrangement of the board 42 and contact traces 44 and their connection with the first ends of the wires 17. However, any suitable shape of the inner housing 20 may be provided including square and circular. In the embodiment shown, fixedly connected to the inner housing 20 is the shell 26. The shell 26, in the embodiment shown, is comprised of an electrically conductive material which is electrically connected to the copper tape in the inner housing 20 and thus the ground wire in the cable 16. The copper tape and shell 26 cooperate to act as an electrical shield for the contact element 18 and wire first ends as is known in the art. The shell 26 is fixedly connected to the inner housing 20 and has a center channel 46 with a relatively open forward end 48 having a relatively trapezoidal cross-sectional shape which forms the center channel 46. The trapezoidal shape of the center channel 46 is generally provided to prevent the connector 10 from being inserted into a receptacle connector except in a predetermined orientation and for insertion with only a mating receptacle connector. The contact element 18 generally extends forward from the dielectric material of the inner housing 20 into the center channel 46 of the shell 26 and is suitably spaced from the walls of the shell 26 for insertion into a receptacle slot 200 (see FIG. 5) in the receptacle connector 12; portions of the receptacle connector 12 being received in the center channel 46 between the contact element 18 and shell 26. However, in an alternate embodiment of the present invention, the shell 26 need not be provided or may have any suitable shape of center channel 46 or means for keying insertion of the plug connector 10 into the receptacle channel 12.

Figure 2:
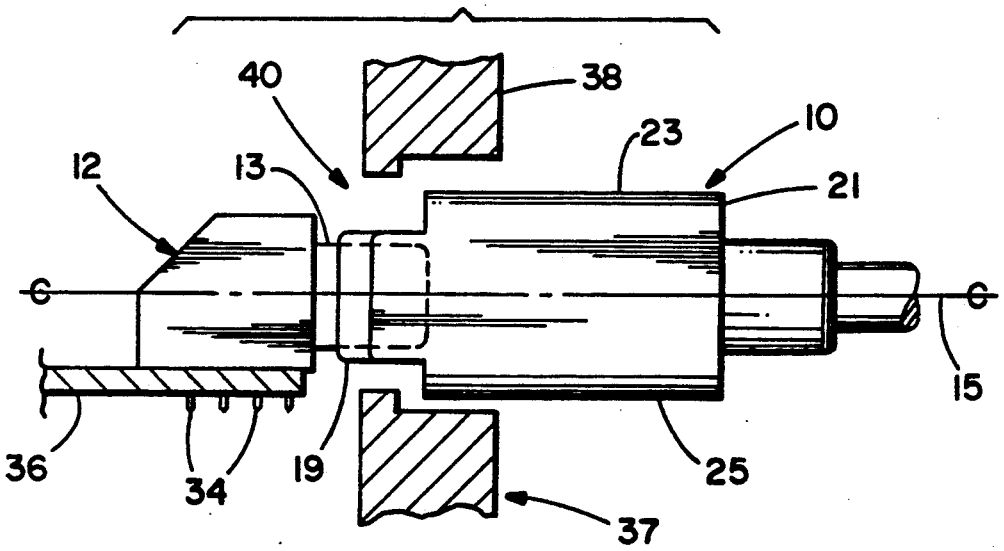
FIG. 2 is a schematic cross-sectional side view of the receptacle connector and plug connector of FIG. 1 connected together.

Referring also to FIG. 2, a schematic cross-sectional view of the plug connector 10 and receptacle connector 12, located in an electrical or electronic component 37, are shown connected to each other. The plug connector 10 generally has a forward or connection end 19, a rear end 21, and four sides including a top 23, a bottom 25, and opposite sides 27 and 29 (see FIG. 1) between the top 23 and bottom 25. The receptacle connector 12 is located inside a frame 38 of component 37 and attached to a printed circuit board 36. The receptacle connector 12 has a forward or connection end 13 that mates with the forward end 19 of the plug connector 10 along the center axis 15 of the plug connector 10. The component frame 38 has a suitable aperture 40 such that the plug connector 10 can pass therethrough. The plug connector 10, in the embodiment shown, due to the channel shapes of shell 16 and the forward end 13 of receptacle connector 12, can only be connected to and disconnected from the receptacle connector 12 by movement of the plug connector 10 in a direction along its center axis 15. Insertion and removal of the plug connector 10 with the receptacle connector 12 will be further described below.

Figure 3:
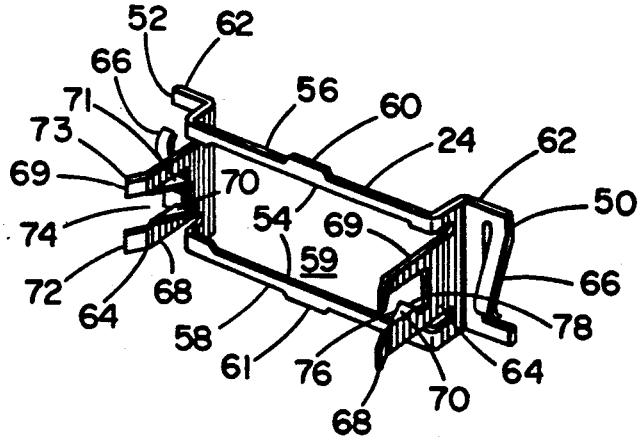
FIG. 3 is a front perspective view of the latch used in the plug connector shown in FIG. 1.

Referring also to FIG. 3, there is shown a perspective view of the latch 24. In the embodiment shown, the latch 24 generally comprises a first side portion 50, a second side portion 52, and a center connecting portion 54. The center connecting portion 54 is generally comprised of a top section 56 and bottom section 58 which combine with the first and second side portions 50 and 52 to form a relatively rectangular or box shaped aperture 59. However, any suitably shaped aperture 59 may be provided. In addition, the latch 24 need not form a closed box shape as shown, but may merely be provided as individual side portions without connecting portion 54. In the embodiment shown, however, the connector portion 54 is provided to give structural rigidity to the side portions 50 and 52 and to help facilitate the mounting of the latch 24 to the inner housing 20. The top and bottom sections 56 and 58 of the center connecting portion 54 also comprise hood stops 60 and 61, respectively. The first and second side portions 50 and 52 are substantially mirror images of each other and each is comprised of a base portion 62 and a leg portion 64. Each base portion 62, in the embodiment shown, is intended to sit against a side ledge 33 of the inner housing 20 and has a spring leg 66 that extends therefrom. Each leg portion 64 is provided as a cantilever from their base portions 62 and, in the embodiment shown, has a first leg 68 and a second leg 69 which both extend in a forward direction substantially perpendicular to the center connecting portion 54. The first leg 68 is generally linear or straight and also comprises a projecting prong 70 and a sloped leading tip 72. The second leg 69 is substantially a mirror image of the first leg 68 and is generally linear or straight and also comprises a projecting prong 71 and a sloped leading tip 73. The leading tips 72 and 73 on both side portions 50 and 52 can act as latch release portions at the distal ends of the leg portions 64 as will be described below. A space 74 is generally provided between the two legs 68 and 69. Prongs 70 and 71 generally face or project inward from their respective side portions 50 and 52 towards the opposite side portion. In an alternate embodiment of the present invention, only one leg need be provided on each side portion 50 and 52. In addition, prongs 70 and 71 need not project inward, but may project outward, upward, downward, or in different various directions. In the embodiment shown, prongs 70 and 71 are generally wedge shaped having a forward inclined or sloped surface 76 and a relatively flat or non-sloped rear surface 78. Preferably, the latch 24 is comprised of sheet metal that is cut and folded to form its desired shape. However, any suitable type of material can be used and any suitable shape of latch may be provided. In the embodiment shown, the latch 24 is fixedly connected to the inner housing 20.

Figure 4:
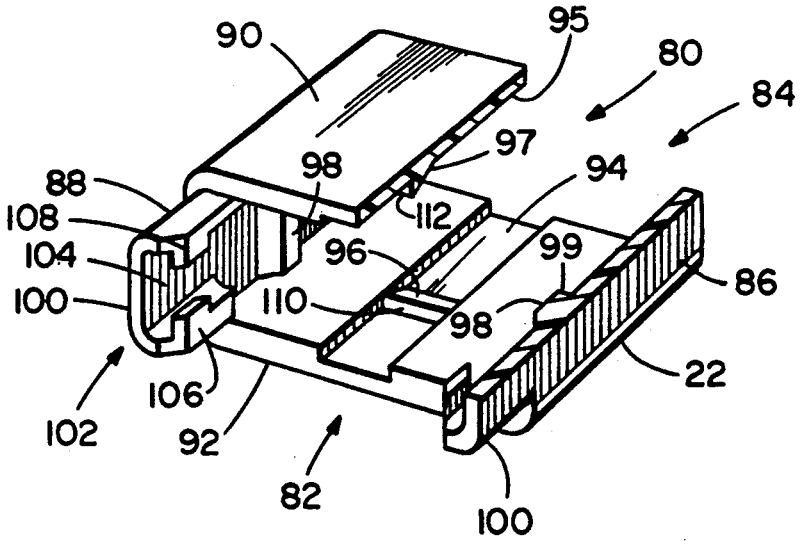
FIG. 4 is a front perspective view of the hood of the plug connector shown in FIG. 1 with a cut away section.
Figure 6:
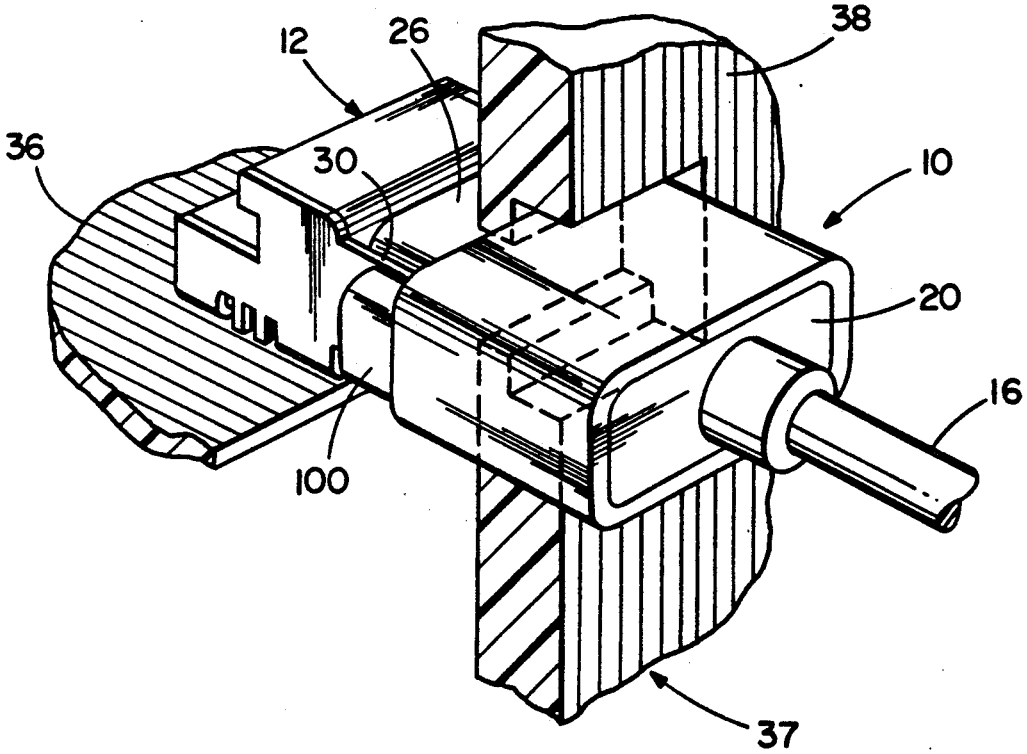
FIG. 6 is a cut away perspective view of the two connectors shown in FIG. 1 connected together in a component.
Figure 7:
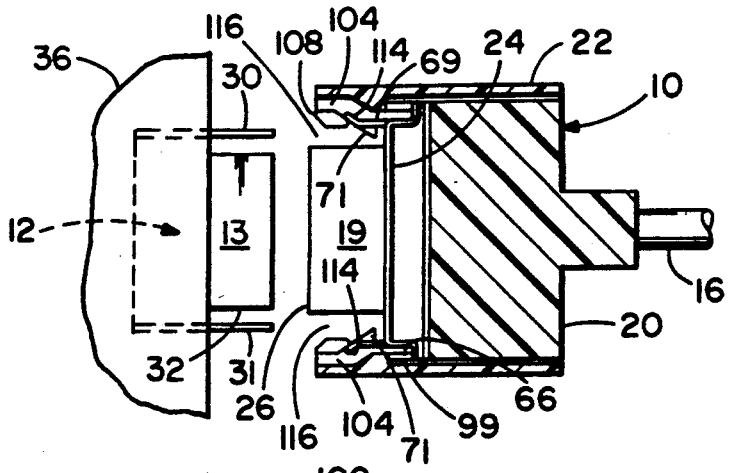
FIG. 7 is a bottom view of the two connectors shown in FIG. 1 prior to connection with a cross-sectional view of the plug connector.

Referring also to FIG. 4, a perspective view of the hood or outer sleeve 22 is shown with a cut away section. In the embodiment shown, the hood 22 is generally comprised of a dielectric material and has a single piece configuration with a general rectangular shape having a rectangular shaped aperture 80 passing from a forward end 82 through to a rearward end 84. The hood 22 generally has a first side wall 86 a second side wall 88, a top wall 90 and a bottom wall 92. Located inside the aperture 80 on the interior of the top and bottom walls 90 and 92 are two slots 94 and 95 having wedges 96 and 97 therein with stop faces 110 and 112. The slots 94 and 95 allow the hood 22 to be slidingly mounted over the inner housing 20 by allowing the hood stops 60 and 61 on the latch 24 to be slid therethrough. The wedges 96 and 97 are intended to allow the hood 22 to be pass over the hood stops 60 and 61 and, after mounting of the hood 22 to the inner housing 20, the stop faces 110 and 112 can cooperate with the hood stops 60 and 61 for limiting forward movement of the hood 22 relative to the inner housing 20 as will be described below. However, any suitable means may be provided for allowing the hood 22 to be slidingly mounted over the inner housing 20. Alternatively, the hood 22 need not be slidingly mounted, but may comprise two half pieces that are snapped together or otherwise fixedly connected to each other over the inner housing 20. In addition, any suitable means may be provided for limiting forward as well as rearward movement of the hood 22 on the inner housing 20. In the embodiment shown, the first and second side walls 86 and 88 are substantially mirror images of each other and each comprises a spring ledge 98 and a forward extension 100. The spring ledges 98 generally have flat rear faces 99 which are intended to contact forward portions of the spring legs 66 on the latch 24. The spring ledges 98 also act as limiters for limiting rearward movement of the hood 22 on the inner housing 20. Each extension 100 generally forms a latch disconnect 102 having a channel 104, an upward extending wedge member 106 and a downward extending ledge member 108. The extensions 100 extend or project in front of the forward opening to the center aperture 80 and are suitably spaced such that the latch grips 30 and 31 of the receptacle connector 12 may be slid along or in close proximity to the interior facing surfaces of the extending members 106 and 108 as shown in FIG. 6. The extensions 100 are also suitably sized and shaped to receive forward portions of the two latch leg portions 64. Referring also to FIG. 7, with the hood 22 in a home position relative to the inner housing 20, the upward and downward extending ledge members 106 and 108 each have a rearward sloped inner face 114 that contacts the leg angled leading tips 72 and 73, respectively. Alternatively, any suitable surface on the hood 22 may be provided for contacting and moving legs 68 and 69. A space 116 is generally provided on both sides of the shell 26 between the upward and downward extending ledge members 106 and 108 and the shell 26 for passing the receptacle connector latch grips 30 and 31 into. The prongs 70 and 71 extend into these spaces 116 in the home position shown.

After assembly of the cable 16 with the connector element 18, inner housing 20, shell 26 and latch 24, the hood 22 can be connected thereto. In the embodiment shown, the rear end 84 of the hood 22 is slid over the shell 26, latch 24 and inner housing 20. The hood stops 60 and 61 can pass through the hood slots 94 and 95 until they reach the wedges 96 and 97. Upon further pushing of the hood 22, the top and bottom walls 90 and 92 of the hood 22 can deflect or bow outward slightly by the wedging action of the wedges 96 and 97 against the hood stops 60 and 61 until the hood stops 60 and 61 pass under the wedges 96 and 97 and the top and bottom walls 90 and 92 of the hood 22 snap back with the hood stops 60 and 61 being located in the forward portions of the grooves 94 and 95. As the wedges 96 and 97 pass over the hood stops 60 and 61, the leading tips 72 and 73 of the legs 68 and 69 on both by leg portions 64 of the latch 24 contact the sloped inner faces 114 on extensions 100. Also as the wedges 96 and 97 pass over the hood stops 60 and 61, the leading portions of the spring legs 66 of the latch 24 contact the rear faces 99 of the spring ledges 98 with the spring legs 66 being slightly depressed and creating a biasing force between the hood 22 and inner housing 20 to bias the hood 22 in a forward direction. Once the hood stops 60 and 61 are located in the forward portion of the grooves 94 and 95, although the spring legs 66 bias the hood 22 in a forward direction relative to the inner housing 20, the hood stops 60 and 61 and the stop faces 110 and 120 limit the forward position of the hood 24.

Figure 5:
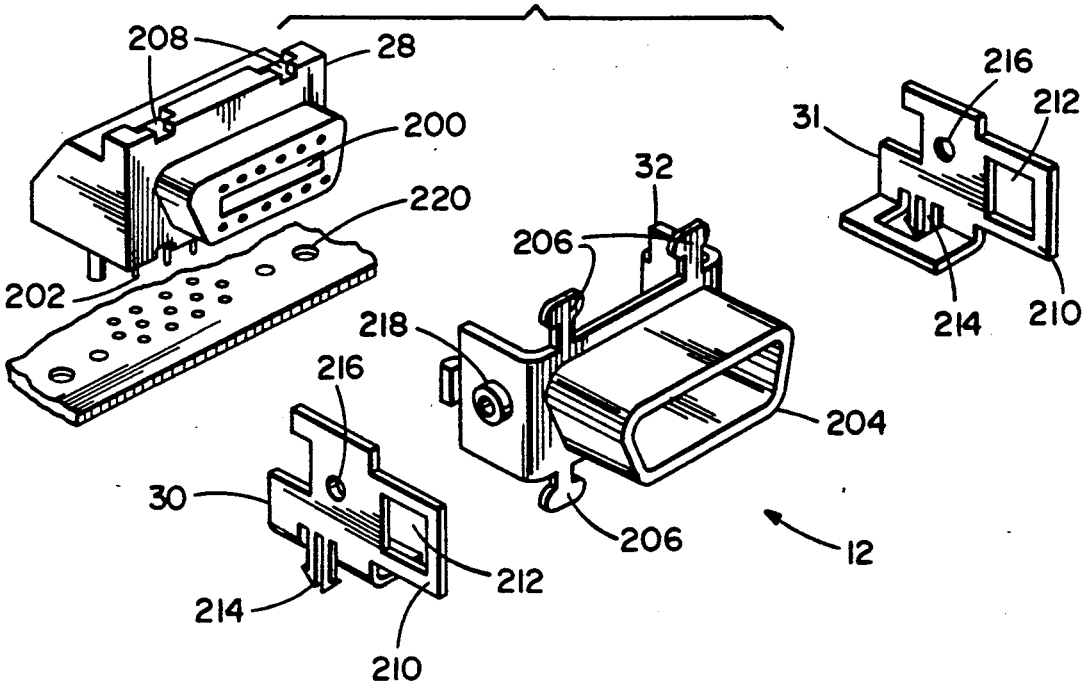
FIG. 5 is an exploded perspective view of the receptacle connector shown in FIG. 1.
Figure 5A:
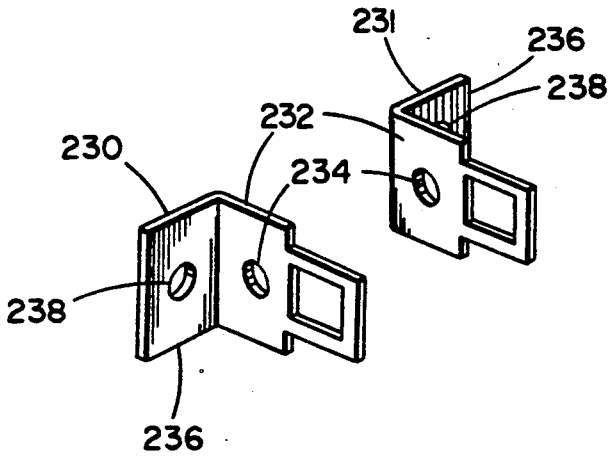
FIG. 5A is a perspective view of alternate latch grips for use in a receptacle connector.

Before describing the connection and disconnection of the plug connector 10 to the receptacle connector 12, one embodiment of a receptacle connector will be described. Referring to FIG. 5, an exploded view of the receptacle connector 12 is shown which generally comprises a housing 28 having a slot 200, and outer shell 32 and two separate latch grips 30 and 31. The housing 28 is generally comprised of a molded dielectric material and has spring contacts 202 therein. The slot 200 is suitably sized and shaped to receive board 42 of the plug contact element 18. The shell 32 is generally comprised of an electrically conductive material and covers a portion of the housing 28. The shell 32 has a trapezoidal shaped portion 204 that is suitably sized and shaped to be received in the plug connector shell center channel 46. Top and bottom legs 206 are deformed into slots 208 in the housing 28 to fixedly connect the shell 32 to the housing 28. The latch grips 30 and 31 are substantially mirror images of each other and comprise a leading portion 210, latch holes 212, posts or mounting prongs 214 and shell mounting holes 216. The latch holes 212 are for receiving the prongs 70 and 71 of the plug connector latch 24. The leading portions 210 are for moving the plug connector latch legs 68 and 69 during connection of the two connectors 10 and 12 and for cooperating with the plug connector latch 24 to retain the two connectors 10 and 12 once connected. The shell mounting holes 216 are provided for passing a portion of a rivet 218 (see FIG. 1) therethrough for fixedly connecting the latch grips 30 and 31 with the shell 32. However, any suitable type of means for fixedly connecting the latch grips 30 and 31 to the shell 32 or housing 28 may be provided. The shell 32 and latch grips 30 and 31 may also be provided as a single piece member. FIG. 5A shows an alternate embodiment of latch grips 230 and 231. In the embodiment shown, the latch grips 230 and 231 each have a side portion 232 with a hole 234 for a rivet (not shown) and a front portion 236 with a hole 238 for a fastener (not shown). The latch grips 230 and 231 are intended to be directly connected to the frame of a component, thereby directly mechanically connecting a receptacle connector to the frame for a relatively strong connection. In the embodiment shown in FIG. 5, the mounting prongs 214 are provided for fixedly connecting the receptacle connector 12 to holes 220 in circuit board 36 or a back up plate. In a preferred embodiment, the latch grips 30 and 31 are made of metal or other relatively rigid and strong material to prevent inadvertent mechanical failure at the connection between the receptacle connector 12 and the member it is mounted to such as the circuit board 36. The increased strength in the connection of the receptacle connector 12 to the member it is mounted to need not be provided, but is a preferred embodiment for use with the plug connector 10 for reasons as will be described below. It should be understood that the above description of one embodiment of a receptacle connector is not intended to be an exhaustive description of all possible alternative embodiments. For example, the slot 22 can be replaced with a plurality of pin receiving holes. Alternatively, the receptacle connector can have projecting pin contacts. In addition, the housing need not provide for a right turn of its contacts. Obviously, any suitable receptacle connector may be provided and need not be provided with an outer shell or separate latch grips.

Figure 8:
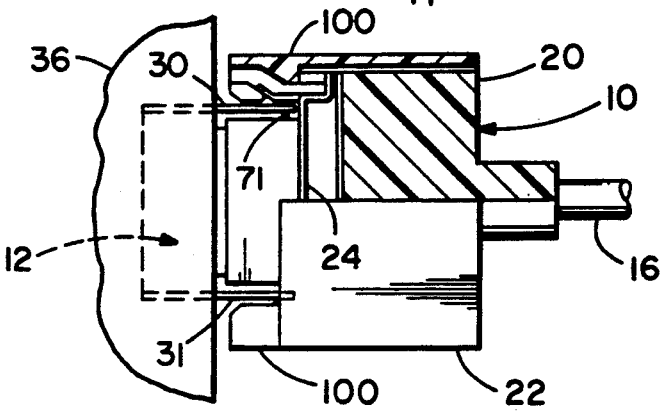
FIG. 8 is a bottom view of the two connectors as shown in FIG. 7 at their final connected position with only a partial cross-sectional view of the plug connector and a partial plan view.

Connection of the plug connector 10 to the receptacle connector 12 by a user is relatively simple and uses the latch 24 as a mechanical lock to, at least temporarily, fixed connect the two connectors. Referring also to FIGS. 7 and 8, in the embodiment shown, in order to connect the two connectors a user pushes the forward end 19 of the plug connector 10 towards the forward end 13 of the receptacle connector 12 along the center axis 15 (see FIG. 2) of the plug connector 10. The receptacle connector shell 32, housing 28 and slot 200 (see FIG. 9) can pass into the center channel 46 of the plug connector shell 26 with the contact element 18 passing into the slot 200. The receptacle connector latch grips 30 and 31 can pass through two spaces 116 between the shell 26 and extensions 100. As the latch grips 30 and 31 advance through the spaces 116, their leading portions 210 contact the inclined surfaces 76 of the prongs 70 and 71 on both side portions 50 and 52 of the latch 24. This causes the legs 68 and 69 on both leg portions 64 to bend or defect outward until the prongs 70 and 71 pass the leading portions 210 of the latch grips 30 and 31 and snap back into latch grips holes 212. In this connected position, as shown in FIG. 8, the non-sloped or flat surface 78 of the prongs 70 and 71 cooperate with the rear faces of the leading portions 210 of the latch grips 30 and 31 to substantially prevent disconnection of the two connectors 10 and 12. Thus, a relatively fast and easy to operate snap-lock connection between the two connectors is provided. Also in this connected position, the contact traces 44 on the contact element 18 contact the contacts 202 in receptacle connector slot 200, thus electrically connecting wires 17 with the circuit board 36. In an alternate embodiment the leg portions 64 can bend inward, upward, and/or downward.

For the plug connector 10 shown, disconnection of the plug connector 10 from the receptacle connector 12 can be accomplished in two fashions; an emergency disconnect and an user disconnect. The emergency disconnect is generally provided for situations when the cable 16 is pulled by an excessive force that could otherwise cause the cable assembly 14 to move the component 37, such as if a person were to trip on the cable 16 which could cause the component 37 to be pulled off a table and become damaged. In the embodiment shown, the latch 24 is designed to unlatch from the latch grips 30 and 31 upon a predetermined amount of tension being exerted between the connectors 10 and 12 such as an equivalent to about 15 pounds force. However, it should be noted that this emergency disconnect need not be provided or may be provided for disconnect at any desired tensile force. In the embodiment shown, the points of contact between the plug connector prong flat faces 78 and the rear of the receptacle connector latch grip leading portions 210 is offset from the linear portion of legs 68 and 69. Thus, when tension is applied, the offset force at the prongs creates a moment in the legs 68 and 69 which causes the legs 68 and 69 to automatically bend outward until the bending finally causes the prongs 70 and 71 on both side of the latch 24 to automatically exit the holes 212 in the latch grips 30 and 31. Hence, the main obstacle to disconnection having been removed, the plug connector 10 can relatively easily pop out and away from the receptacle connector 12 thereby disconnecting the two connectors due to the tensile force and preventing the component 37 from being pulled by the cable assembly 14.

Figure 9:
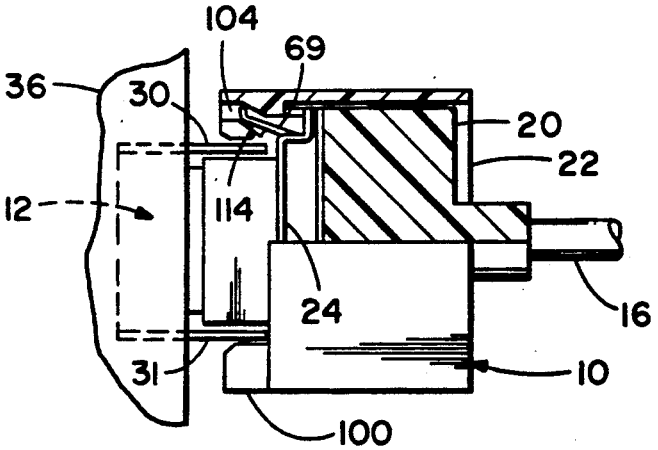
FIG. 9 is a bottom view of the two connectors as shown in FIG. 8 with the outer hood of the plug connector having been moved rearward to disconnect a latch from the receptacle connector to allow for relatively easy disconnection of the plug connector from the receptacle connector.

The user disconnect of the plug connector 10 from the receptacle connector 12 generally involves the user moving the hood 22 relative to the inner housing 20 to move the legs 68 and 69 of the latch 24. The hood 22 is generally movable from its forwardly biased home position to a disconnect position as shown in FIG. 9. In order to obtain this disconnect position, a user grasps the hood 22 and pulls on the hood in a rearward direction along the center axis of the plug connector 10. With the hood shown, which substantially surrounds the entire accessable area of the connector 10, a user can grasp the hood at any location. The hood 22 is slidably mounted, at least partially, on the inner housing 20. The latch 24 and friction between the front end 13 of the receptacle connector 12 and the front end 19 of the plug connector 10 generally prevent the inner housing 20 from moving with the hood 22 until the hood 22 reaches its disconnect position. Thus, the hood 22 moves rearward relative to the inner housing 20 compressing the spring legs 66 of the latch 24. As the hood 22 moves rearward, the sloped inner faces 114 of the extension wedge members 106 and 108 wedge the leading tips 72 and 73 and prongs 70 and 71 into the extension channels 104. Upon reaching the disconnect position, the prongs 70 and 71 on both sides are removed from the latch grip holes 212. By further pulling on the hood 22, the main obstacle to disconnection having been removed, the plug connector 10 can simply slide away from the receptacle connector 12. After disconnection the hood 22 will merely return to its home position by the biasing action of spring legs 66 and is ready to be reconnected when desired. In a preferred embodiment, the longitudinal movement of the hood 22 on the inner housing 20 from the home position to its disconnect position is about 0.1 inch long. However, any suitable length of travel can be provided.

As is obvious from the above description, the snap-lock action of the latch 24 and quick release by use of the movable hood 22 provides a relatively simple and easy connector that is faster to connect and disconnect and still provides the necessary removable connection with temporary fixation. In addition, the present invention also provides an emergency release or disconnect not available in prior art connectors. Although the emergency disconnect need not be provided, in a preferred embodiment it is provided. In addition, the relatively strong and rigid receptacle connector latch grips 30 and 31 can allow the emergency disconnect to operate properly without damaging the receptacle connector shell 32, housing 28 or connection to the member the receptacle connector 12 is mounted to and can allow emergency disconnect at relatively high tensile forces of about 30 to 50 pounds or even higher. The present invention can also be used to provide for a recessed connection at least partially inside the frame of a component. Referring to FIGS. 2 and 6, the component 37 can be provided with an aperture 40 having a stepped configuration as shown. The front end 13 of the receptacle connector 12 can be located inside the aperture 40 and the front end 19 of the plug connector 10 can project into the component 37 past the frame 38 with the hood 22 also being at least partially received in the aperture 40. In the embodiment shown, the size of the aperture 40 and the size of the hood 22 provide only relatively small spaces therebetween, thus protecting and shielding the connection of the two connectors. Because user disconnect is accomplished by grasping and moving the hood 22, even though the front portion of the plug connector is not accessible when connected, a majority of the hood 22 is. Therefore, recessing of the front portion of the plug connector 10 inside the frame of a component does not hinder disconnection. In addition, the user can grasp the hood at any location and need not grasp a specific location on the hood 22.

Figure 10:
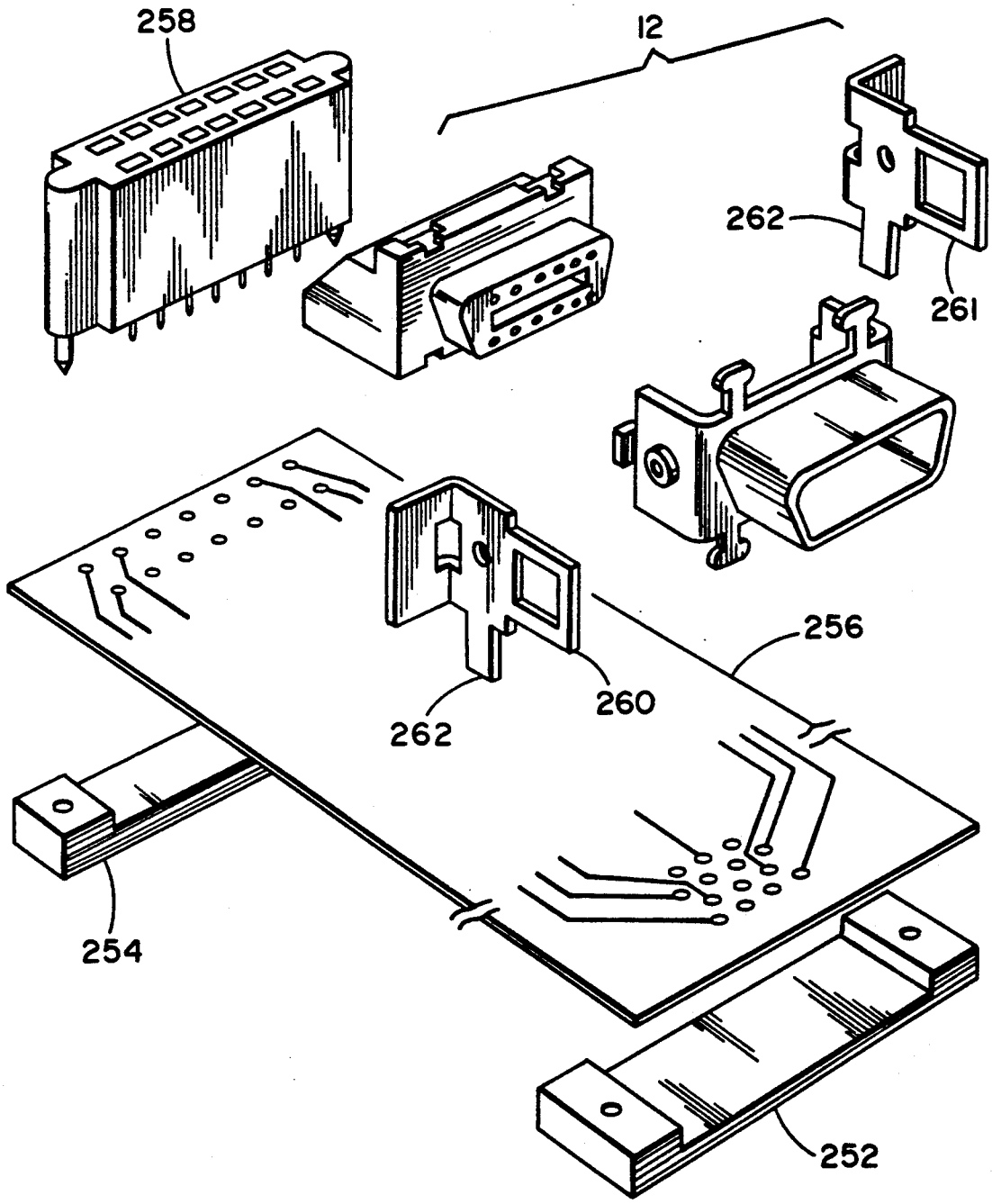
FIG. 10 is an exploded perspective view of an alternate embodiment of the receptacle connector and a flexible printed circuit assembly.

Referring now to FIG. 10, an exploded view of a pitch conversion assembly 250 is shown with an exploded view of a receptacle connector 12. The assembly 250 has a first back-up plate 252, a second back-up plate 254, a flexible printed circuit 256, a socket connector 258 and the receptacle connector 12. The first and second back-up plates 252 and 254 can be fixedly connected to a component frame. The contacts (not shown) of connector 12 can be connected to conductors in the flexible printed circuit 256 with post 262 of latch grips 260 and 261 being fixedly connected to the first back-up plate 252. The flexible printed circuit can change the conductor pitch as is known in the art for use with socket connector 258.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A method of manufacturing a cable connector assembly for use in connecting a plurality of electrical wires in a cable to a second connector, the method comprising the steps of:

connecting first ends of the wires to a multiple contact element;

covering, at least partially, the wire first ends and contact element with an electrically insulative material and, at least partially forming a housing therewith;

connecting a latch to the housing, the latch having at least one forward extending latch leg with a latch prong at a forward end thereof; and mounting a movable hood to the housing, the hood being longitudinally movable along the housing between a home position and a disconnect position and having a latch disconnect located in a forward portion of the hood, the step of mounting includes locating the latch disconnect proximate the forward end of the latch leg to be able to move the forward end of the latch leg such that when the hood is moved from its home position to its disconnect position the latch disconnect can disconnect the latch from a latch grip connected to a second connector.

2. A method as in claim 1 wherein the step of mounting the hood to the housing comprises the hood having at least two hood members that are connected together over the housing.

3. A method as in claim 1 further comprising the step of biasing the hood in a forward position by a spring located between a portion of the housing and a portion of hood.

4. A method as in claim 1 wherein the step of connecting the latch to the housing comprises the latch having a generally rectangular aperture for sliding the latch over a generally rectangular portion of the housing.

5. A method of disconnecting a plug connector having at least one row of contacts therein from a receptacle connector having at least one row of contacts therein, the method comprising the steps of:

manufacturing a cable connector assembly as in claim 1 as the plug connector, the latch having two side legs;

slidably moving the hood of the plug connector from a home position along the housing of the plug connector to a disconnect position, the hood substantially surrounding the housing and being fixedly but slidably mounted thereon in a direction along a center axis of the housing;

laterally moving the two side legs of the latch connected to the plug connector housing and thereby displacing a latch prong on each side leg from a hole in a latch grip of the receptacle connector, the hood having a latch release that simultaneously moves the side legs as the hood is moved; and further pulling on the hood to remove the plug connector housing from the receptacle connector.

* * * * *